US011359443B2

(12) United States Patent
Boike et al.

(10) Patent No.: US 11,359,443 B2
(45) Date of Patent: Jun. 14, 2022

(54) GROUND DRILLING DEVICE FOR CABLE-GUIDED DRILLING, METHOD FOR CABLE-GUIDED GROUND DRILLING , AND USE DURING CABLE-GUIDED DRILLING

(71) Applicant: TRACTO-TECHNIK GmbH & Co. KG, Lennestadt (DE)

(72) Inventors: Volker Boike, Lennestadt (DE); Stefan Hermes, Lennestadt (DE); Dieter Wurm, Kirchhundem (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 0 days.

(21) Appl. No.: 16/784,873

(22) Filed: Feb. 7, 2020

(65) Prior Publication Data

US 2020/0263509 A1 Aug. 20, 2020

(30) Foreign Application Priority Data

Feb. 15, 2019 (DE) ..... 10 2019 001 109.0

(51) Int. Cl.
*E21B 19/084* (2006.01)
*E21B 17/00* (2006.01)
*E21B 7/04* (2006.01)

(52) U.S. Cl.
CPC ..... *E21B 19/084* (2013.01); *E21B 7/046* (2013.01); *E21B 17/003* (2013.01)

(58) Field of Classification Search
CPC ..... E21B 17/003; E21B 17/023; E21B 19/08; E21B 19/084; E21B 23/14; E21B 19/008
See application file for complete search history.

(56) References Cited

U.S. PATENT DOCUMENTS

| | | | | |
|---|---|---|---|---|
| 2,370,818 | A * | 3/1945 | Silverman | G01V 3/34 324/356 |
| 5,105,878 | A | 4/1992 | Forest et al. | |
| 6,655,453 | B2 * | 12/2003 | Head | E21B 23/14 166/77.1 |
| 7,350,589 | B2 * | 4/2008 | Head | E21B 17/023 166/385 |
| 7,416,028 | B2 * | 8/2008 | Prendin | E21B 23/14 166/381 |
| 9,470,054 | B2 * | 10/2016 | Talgo | E21B 47/135 |
| 2002/0104661 | A1 * | 8/2002 | Head | E21B 23/14 166/380 |
| 2005/0161231 | A1 * | 7/2005 | Prendin | E21B 23/14 166/385 |
| 2005/0167121 | A1 * | 8/2005 | Head | E21B 47/12 166/385 |

(Continued)

FOREIGN PATENT DOCUMENTS

| | | |
|---|---|---|
| DE | 202 02 395 U1 | 6/2002 |
| EP | 0 900 317 B1 | 2/2001 |

(Continued)

*Primary Examiner* — Jennifer H Gay
(74) *Attorney, Agent, or Firm* — Howard IP Law Group, PC

(57) ABSTRACT

A ground drilling device for cable-guided drilling comprising a drive for connecting and/or moving rod sections of a drill string along a drill string axis, wherein a cable reserve for receiving a cable with a length of at least two rod sections is provided and a contact device for electrical contacting of one end of the cable of the cable reserve is provided.

21 Claims, 2 Drawing Sheets

(56) References Cited

U.S. PATENT DOCUMENTS

| | | | | |
|---|---|---|---|---|
| 2014/0174716 | A1* | 6/2014 | Talgo | E21B 33/037 166/65.1 |
| 2015/0167449 | A1* | 6/2015 | Rodney | H02G 9/06 166/385 |
| 2020/0263509 | A1* | 8/2020 | Boike | E21B 3/02 |

FOREIGN PATENT DOCUMENTS

| | | | | |
|---|---|---|---|---|
| EP | 3828375 | A1 * | 6/2021 | E21B 23/14 |
| WO | WO-2007121510 | A1 * | 11/2007 | E21B 7/028 |

* cited by examiner

GROUND DRILLING DEVICE FOR CABLE-GUIDED DRILLING, METHOD FOR CABLE-GUIDED GROUND DRILLING , AND USE DURING CABLE-GUIDED DRILLING

FIELD OF INVENTION

The invention relates to a ground drilling device for cable-guided drilling comprising a drive for connecting and/or moving rod sections of a drill string along a drill string axis, a method for cable-guided ground drilling, in which a rod section, which is part of a drill string drilled into the ground and in which a cable is present, is connected to another rod section, and also a use during cable-guided ground drilling, during which rod sections are used, in which a cable is arranged, wherein cables of adjacent rod sections are connected to one another.

BACKGROUND

In order to be able to exactly control a borehole, a most precise position detection of the drilling head in the ground is necessary. There are essentially two different methods available for this purpose.

The determination of the position of the drill head may be carried out by a transmitter in the drill head using an electromagnetic field through the ground, for which a method known as a walk-over method is used. The walk-over method enables a fast localization and an uncomplicated application is possible. The drill head is localized using a reception strength meter (receiver), located above the ground, wherein the maximum signal strength of the transmission signal of the transmitter in the drilling head is determined depending on the position of the reception strength meter above ground. The signal strength is thereby dependent on the transmitter depth in the ground, by which means a depth determination is possible. However, deviation tolerance increases at increasing borehole depths.

Cable-guided drilling is used for localizing the drill head for large depths, for a higher precision in lower depths, and/or under screening or completely inaccessible obstacles. For this purpose, each section of the drill string, in particular each rod section, is provided with a cable lying on the inside, which is connected to the adjacent sections of the drill string, in particular to additional rod sections. On the end side, the cable is guided to the outside after each addition of a rod section and connected to a slip ring, at which data from a sensor on the drill head or from a position adjacent to the drill head, may be tapped. The data may be displayed to an operating person, in particular in an operating cabin. For changing rods, it is necessary that the cable is connected on the one hand to the cable of the adjacent, already drilled rod section or to another section of the drill string, wherein the connection is manually protected in an electrically insulating way, and on the other hand, the free end of the cable of the newly added rod section must be guided through the drill string to the outside and connected to the slip ring. The previously used process and the previously used devices are time intensive and costly.

SUMMARY

It is therefore the object of the present invention to create a ground drilling device, a method, and a use, with which the expense with respect to time and/or costs may be reduced.

The core concept of the invention is to provide a cable reserve with a length of at least the length of two rod sections, in which one end of the cable reserve is, as far as possible, in permanent contact with a contact device for electrical contacting of the end of the cable in order to not have to constantly separate and reconnect one of the electrical contacts when adding a rod section or when changing rods. The inventors have broken with the concept, that one cable section has to be used for a new section of the drill string to be added, i.e., in particular a rod section, that the cable for each new rod section to be added has to be connected, on the one hand, at one end to the end of the cable in the already drilled drill string, and has to be connected, on the other hand, at the other end to the slip contact provided on the ground drilling device for extracting signals from the cable. When adding a rod section or when changing a rod, the drive is detached from the already drilled drill string and a rod section is introduced into the drill string axis and is connected to the drive. The rod section connected to the drive is then connected to the rod section drilled into the ground so that, according to the previous conception, the newly added rod section has to be newly contacted to both of its respective ends. This concept was previously transferred to the newly added cable. It is a credit to the inventors to have recognized this and to have broken with this idea.

The inventors have thus distanced themselves from the idea that the cable has to be introduced into the drill string the same way that the connection is carried out of the newly added rod section into the drill string.

Although only one connection of the cable of the cable reserve to the cable of the already drilled drill string is carried out, there is a continuous possibility—after only carrying out this one connection—of transmitting signals to the end of the cable reserve along the drill string axis up to the other end of the cable in the front side area of the drill string, and receiving them from the same.

The invention creates a ground drilling device for cable-guided drilling comprising a drive for connecting and/or moving rod sections of a drill string along a drill string axis. A cable reserve for receiving a cable with a length of at least two rod sections is provided, and a contact device for electrical contacting of one end of the cable reserve is provided. By this means, the possibility is created that, when lengthening the drill string already drilled into the ground by an additional rod section, in which a cable has to be arranged, only one connection is provided to the cable located in the already drilled drill string in order to connect the same to the cable of the cable reserve and to electrically insulate it.

In the meaning of the description, a "ground drilling device" is any device which moves, in particular, a drill string having rod sections, in an existing channel or a channel to be established in the ground, in order to establish or to expand a borehole, in particular horizontal drilling (HD), or in order to insert pipes or other long bodies into the ground. The ground drilling device may be, in particular, a horizontal drilling device. A ground drilling device may thus be a device driving a drill string, which functions in a soil displacing way, and which inserts the drill string into the ground translationally and/or rotationally in the longitudinal axial direction of the drill string. A borehole may be introduced into the ground by the application of tension or pressure on the drill string. The term "rod section" in the meaning of the description does not thereby exclusively comprise individual, rigid force transmission elements, directly or indirectly connectable to one another, which may be used by a ground drilling device.

The term "horizontal drilling" (HD) comprises, in the meaning of the present description, in particular an at least partially horizontally arranged borehole or a horizontally arranged channel or pipeline.

The drill string may have a drill head and an optionally provided drill head tip, in particular on the front side end. The drill string may have a front-side drilling tool.

The term "drive" comprises, in the meaning of the description, a drive means, which may move back and forth, which may be configured in particular for a connection to one end of a new rod section to be drilled. The drive means may be connected to one end of the rod section, while the other end of the rod section may be connected to the already drilled drill string. Thus, a lengthening of the drill string may be carried out by means of adding a rod section or switching a rod section. The connection between the drive means and the rod section may be force-fitting and/or form-fitting. The drive means may be moved back and forth by means of a slide on a drilling carriage, in order to impart a tensile force or a pressure force on the drill string connected to the drive means.

The term "drill string axis" comprises in particular the axis, which may be formed by the longitudinal axes of the individual rod sections of the drill string, wherein, in the meaning of the description, the longitudinal axes of the rod sections are considered which are present in closer proximity to the ground drilling device in the drill string. In particular, the rod section may be considered which was drilled last or the rod section, which is drilled or connected closest to the drill string. The drill string axis is hereby in particular the axis, with which the drive receives the new rod section to be drilled and may thus correspond to the longitudinal axis of the new rod section to be drilled. The drill string axis may substantially coincide with the longitudinal axis of the drive means of the ground drilling device.

The term "cable" comprises, in the meaning of the description, a single core or multicore assembly of conductors, sheathed with an insulating material, which functions in particular to transmit energy and/or information. Electric signals may be transmitted via a cable. If the cable has multiple conductors or cores, then a parallel or simultaneous transmission of multiple signals is possible. A connection of cables may be carried out by stripping one end of a cable with another stripped end of a cable, that the cables are clamped together or are otherwise mechanically and/or materially connected to one another. To protect the connection, the connection point may be insulated, in particular using a shrink sleeve.

The term "contact device" comprises, in the meaning of the description, a contact element, with which one end of the cable of the cable reserve is in electrically-conducting contact. The contact device accordingly has an electrically-conducting contact element. The contact element may be in permanent contact with a display and/or a data processing unit, which may be configured as a computing unit, and has a controller or the like. The signals may be displayed on the display, in particular in an operating cabin, particularly preferably after processing by means of the controller.

If it is described that the cable reserve has a length of at least twice the length of one rod section, then this is to be considered a preferred embodiment, which ensures that initially one additional rod section may be connected to the already drilled drill string and a cable may be arranged in the newly added rod section. In one particularly preferred embodiment, the cable reserve has a cable with a length which corresponds to at least the length of three, four, or more rod sections. The cable reserve may have a cable with a length of at least 50 m, preferably at least 60 m, preferably at least 70 m, preferably at least 80 m, preferably at least 90 m, preferably at least 100 m. Depending on the length of the borehole to be carried out, lengths of a cable of a cable reserve that are greater than 100 m are possible.

In one preferred embodiment, the cable reserve has a spool, which is arranged on the ground drilling device. By this means, the cable reserve is brought in a manageable, compact form and secured against tangling or knotting of the cable. It is additionally possible to determine the length during the spooling of the cable onto the spool and/or to detect the consumed portion of the cable during unwinding of the cable.

In one preferred embodiment, the spool is arranged about the drill string axis. by this means, a particularly simple design and a particularly simple arrangement may be created, in which handling is easier.

In the meaning of the description, the term "arranged about the drill string axis" is to be understood in such a way that the center axis of the spool of the cable reserve is aligned concentrically to the center axis of the connection, which coincides with the drill string axis. The axis of rotation of the spool, i.e., the center axis, coincides with the drill string axis. A simple configuration is possible for a simple design. In particular, the cable reserve or the spool may be arranged on the outside and may surround the drill string axis. This type of feeding from outside may be preferred and enables a simple design with low expense when exchanging or refilling the spool with a cable reserve, as the access from outside facilitates handling. A space-saving design is thus possible. Few components are required, which may simplify the design and reduce costs. The mass of the parts/elements, moved when feeding the cable, may be kept low. An expensive hydraulic rotary feedthrough is not necessarily required.

In one preferred embodiment, a cable feeding is present with at least one guide roller, which may be configured as a deflection roller, which functions for an orderly feeding of the cable. By this means, a feeding is enabled, in which the cable reserve may be arranged independent from the drill string axis and/or in which a flexible arrangement of the cable reserve is possible.

In one particularly preferred embodiment, the cable feeding, in particular in the form of a rotary feedthrough, is configured for an axial feeding into the drill string axis. Multiple guide rollers may be provided for this purpose, which deflect the cable into the desired orientation and/or position. While the previous ground drilling device for cable-guided drilling is provided with a slip contact directly on the drive and/or the drive means, the cable reserve and or the cable feeding may also be present outside of an axial axis, wherein in particular a opening at the drive means for manual guiding through of a cable may be omitted. Flexibility is possible in the arrangement of the cable reserve and/or the position of the contact device.

In one preferred embodiment, a seal is provided on the cable feed for sealing against a flushing liquid, which is suppliable to the drill string. A seal may be used, in particular, which substantially permanently seals a feeding opening for the cable from the cable reserve. The opening may be, in particular, an opening arranged in a rotary feedthrough, said opening being coaxial to the new rod section to be drilled, which is connected to the drive means. The possibility exists of further simplifying handling steps, in which the seal does not have to be constantly manually configured. Flushing liquid, potentially pressurized, which does not exit from the drive means may be supplied to the drive means.

A rotary feedthrough may be used which aligns the cable axially into the drill string axis. In particular, the cable may be guided substantially centered by the rotary feedthrough, in particular substantially aligned to the center axis of the drill string. The rotary feedthrough may have an opening on one end for the cable coming from the cable reserve. On the other side, the rotary feedthrough may have a connection, which is to be connected to a rod section of the drill string or to a new rod section, which is connected to the already drilled drill string. The connection may, in particular, jointly rotate with the drill string, if a rotational movement is exerted on the drill string. The connection may be connected directly or indirectly to the drill string. For example, the connection may be connected to a drive means, in particular in the form of a hollow shaft, which may be rotationally moved from outside by the drive; and the drive means may be connected on the other side to the drill string. The drill string may, in particular, be the inner section of a double drill rod section. The drill string may be a "simple" string, in which no inner string is present. The connection at the rotary feedthrough may be configured, in particular, to form a form-fitting with the drill string or the drive means or an adapter.

In one preferred embodiment, the cable reserve is arranged on an end side on a rotary feedthrough, spaced apart to the connection, which is connected directly or indirectly to a rod section. By this means, the cable of the cable reserve may pass through the rotary feedthrough or the connection from behind, or may extend at least partially or completely through the rotary feedthrough. The inventors are also pursuing a previously irrational approach with the previously listed preferred embodiment, that the cable may extend completely through a rotary feedthrough, even though the cable may be constantly accessed. The access may thereby be reduced in particular to an access solely in the area of the newly added or to be added rod section at the end spaced apart from the drill head. For example, the cable may extend, beginning from the supply, through the rotary feedthrough and a drive means in the form of a hollow shaft, which is rotationally driven by a drive, without necessitating a separation or detaching of the connection in and through the listed areas.

In one preferred embodiment, a traction means is present, which may be configured, in particular, in the form of a hydraulic motor. The traction means may be configured as a hydraulic cylinder, electromotor, electro-cylinder, pneumatic motor or cylinder in an alternative or in an additional embodiment. In one alternative or additional embodiment, the traction means may be configured as a spring or spring means or may have a spring or a spring means, with the aid of which a spring bias is exerted on the cable in order to maintain the cable under tension. The traction means is functionally connected to the cable reserve and configured to maintain the cable under tension. By this means, it may be avoided to the greatest extent that the cable is crimped during the connection to the rod section. Due to a possible substantially concentric feeding of the cable, the cable may be held outside of the area that is relevant for the mechanical connection of the rod sections or the sections of the drill string. A concentric feeding of the cable through the drive means with a tensile load of the cable of the cable reserve, in particular in connection with a substantially concentric arrangement of the cable in the already drilled drill string, may be used advantageously in order to hold the cable outside of the elements provided for the connection of the rod sections; cable breakage and/or cable damage may be prevented.

The invention also creates a method for cable-guided ground drilling, wherein the method has the step that a rod section, which is part of a drill string drilled into the ground and in which a cable is present, is connected to another rod section. A cable is provided with a length of at least two rod sections. Furthermore, a constant electrical contact of one end of the cable, having a length of at least twice the length of a rod section, is established during the connection of the rod sections. During the connection of a new cable for a rod section to be added, or during a rod change switch, the previous cable is thus separated and only one connection of the cable of the cable reserve is required in order to drive the drill string farther.

The invention also creates a use during cable-guided ground drilling, in which rod sections are used, in which a cable is arranged, wherein cables of adjacent rod sections are connected to one another. A cable reserve for receiving a cable with a length of at least twice the length of a rod section and a contact device for constant electrical contacting of one end of the cable of the cable reserve are used.

The invention was described based on the three aspects relating to the ground drilling device, a method, and a use. The comments regarding the individual aspects of the invention complement one another in this regard. Comments for one of the aspects apply equally for the other two aspects.

The preceding comments and likewise the subsequent description of an exemplary embodiment do not present waiver of certain embodiments or features.

BRIEF DESCRIPTION OF DRAWINGS

The invention is subsequently described in greater detail with reference to an exemplary embodiment depicted in the figures.

DETAILED DESCRIPTION

Figure 1:
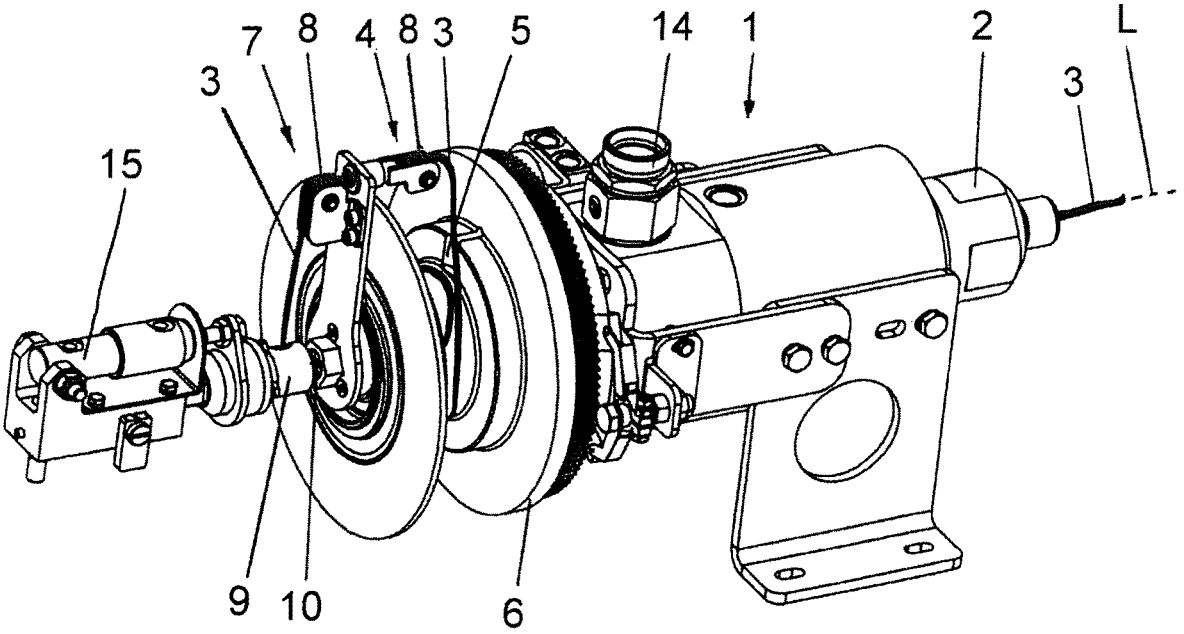
FIG. 1 shows a section in the area of a drive of a ground drilling device with a spool and a cable reserve from one side in an isometric depiction.
Figure 2:
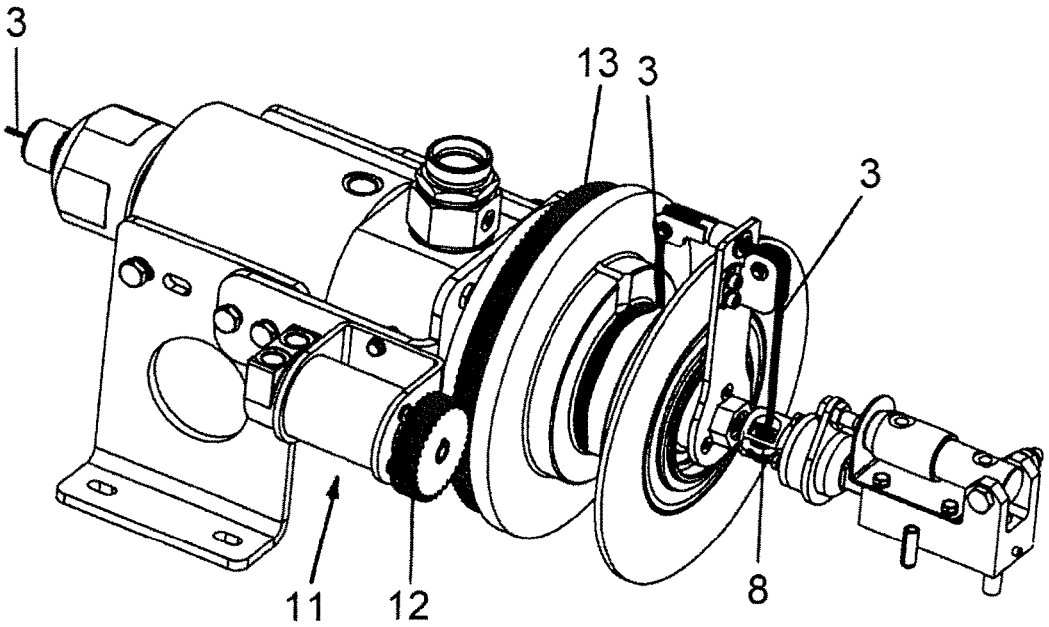
FIG. 2 shows the depiction from FIG. 1 from another side.

FIGS. 1 and 2 show a section in the area of a rotary feedthrough 1 for drilling fluid of a ground drilling device in an isometric depiction from two sides. Rotary feedthrough 1 has a jointly rotating connection 2, which may be brought into connection with a new rod section to be drilled. Connection 2 may be connected to a rear end of a new rod section to be drilled, and the rod section may be connected to the already drilled drill string. Connection 2 defines a drill string axis L, which is depicted by means of a dashed line in FIG. 1.

A cable 3 used for cable-guided drilling is present as cable reserve 4. A contact device 5, which has an electrical contact which is electrically connected to one end of cable 3 of cable reserve 4, is provided on cable reserve 4. Contact device 5 is additionally connected to an electrical connection, which establishes a connection to a display or to a unit processing a signal applied to cable 3. Cable reserve 4 is configured as a spool 6, which may receive a cable 3 with a length of at least two rod sections. One end of cable 3 of cable reserve 4 is guided via a cable feed 7 into axis L of connection 2.

Cable feed 7 has guide rollers 8, configured as deflection rollers, by means of which cable 3 may be guided to connection 2 from behind. Spool 6 is arranged for this purpose on an end side on rotary feedthrough 1 or connection 2. The center axis of spool 6 is aligned concentrically to the center axis of connection 2, which coincides with drill string axis L. Cable 3 is thus guided through connection 2 and may project out of connection 2 at the other end of the same, in order to be connected to a cable of an already drilled drill string.

A seal 9 is present in the area of guide roller 8, which aligns the cable substantially in the longitudinal axial direction of connection 2, said seal being able to seal an opening 10. Pressure may be applied to a cylinder 15 connected to seal 9.

Traction means 11 is provided, with which cable reserve 4 is functionally connected by means of two meshing gears 12, 13. Traction means 11 is functionally connected to the cable reserve in such a way that it may maintain cable 3 of cable reserve 4 under tension. Traction means 11 is configured as a hydraulic motor.

A flushing liquid supply 14 for supplying flushing liquid, in particular bentonite, is provided on rotary feedthrough 1.

Figure 3:
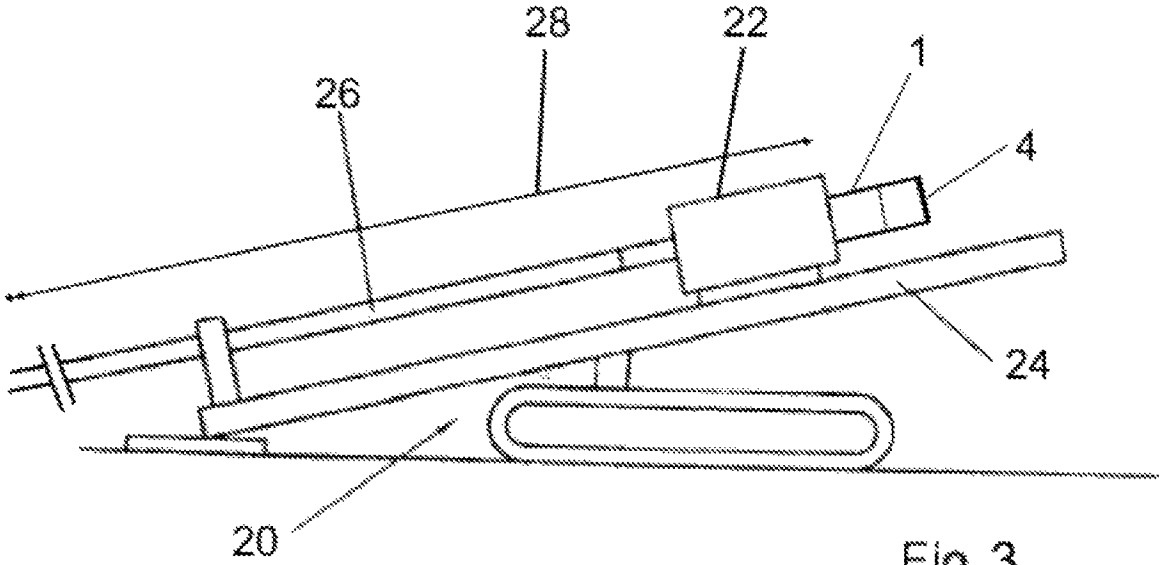
FIG. 3 is a schematic depiction of a ground drilling device from the side with a drill string, rod section, drive, rotary feedthrough, and cable reserve.

FIG. 3 schematically shows a ground drilling device 20. Ground drilling device 20 has a drilling carriage 24 on which drive 22 may be moved back and forth. One end of rotary feedthrough 1 is arranged next to drive 22, and a second end of rotary feedthrough 1 is arranged next to cable reserve 4. Using drive 22, a drill string 28, which has rod sections such as rod section 26, may be moved through the ground translationally and/or rotationally in the longitudinal axial direction of the drill string.

The invention claimed is:

1. A cable feed system for cable-guided drilling with a horizontal ground drilling device, the cable feed system comprising:

a drive for connecting and/or moving rod sections of a drill string along a drill string axis, a cable reserve comprising a cable with a length of at least two rod sections, a rotary feedthrough with a first longitudinal end configured to receive a first end of the cable from the cable reserve and to feed the first end of the cable to a rod section, the rotary feedthrough comprising a jointly rotating connection at a second longitudinal end configured for connecting to a rod section of the drilling string; and an electrical contact for electrically contacting a second end of the cable of the cable reserve.

2. The cable feed system according to claim 1, wherein the cable reserve has a spool.

3. The cable feed system according to claim 2, wherein the spool is arranged about the drill string axis.

4. The cable feed system according to claim 1, further comprising at least one guide roller for feeding the cable.

5. The cable feed system according to claim 4, wherein the cable feed is configured for feeding the cable along into the drill string axis.

6. The cable feed system according to claim 4, further comprising a seal provided on the cable feed for sealing against flushing liquid supplied to the drill string.

7. The cable feed system according to claim 1, wherein the cable reserve is arranged on the first end of the rotary feedthrough such that the cable reserve is spaced apart from the connection at the second end of the rotary feed through for connecting the rotary feed through with a rod section.

8. The cable feed system according to claim 1, further comprising a motor or cylinder functionally connected to the cable reserve, and configured to hold the cable under tension.

9. The cable feed system according to claim 8, wherein when the motor or cylinder comprises the motor, the motor comprises one of an electromotor or a pneumatic motor, and wherein when the motor or cylinder comprises a cylinder, the cylinder comprises one of a hydraulic cylinder, an electro-cylinder, or a pneumatic cylinder.

10. The cable feed system according to claim 1, wherein the cable reserve is arranged on the first longitudinal end side of the rotary feedthrough.

11. The cable feed system according to claim 1, wherein a center axis of a spool of the cable reserve is aligned concentrically to a center axis of the connection, which coincides with the drill string axis.

12. The cable feed system according to claim 1, wherein the cable reserve is configured to rotate independently from the rotary feedthrough and the connection.

13. The cable feed system according to claim 1, wherein the rotary feedthrough comprises an axial opening extending between the first longitudinal end and the second longitudinal end.

14. A method for feeding a cable for cable-guided ground drilling with a horizontal ground drilling device, comprising:

arranging a cable reserve comprising a cable with a length of at least two rod sections on a first end of a rotary feedthrough configured to receive a first end of the cable from the cable reserve and to feed the first end of the cable to a rod section to be attached to an existing rod section of a drill string installed in the ground, wherein the existing rod section comprises an existing cable, establishing a constant electrical contact between a second end of the cable in the cable reserve and an electrical contact connected to a computing device;

connecting the first end of the cable to the existing cable in the existing rod section, and connecting, by a drive, the rod section to the existing rod section of the drill string installed in the ground and in which the existing cable is present.

15. The method of claim 14, wherein the cable reserve comprises a spool arranged about a drill string axis of the drill string.

16. The method of claim 14, further comprising feeding the cable with at least one guide roller.

17. The method of claim 14, wherein the cable reserve is configured for feeding the cable from the cable reserve along a drill string axis of the drill string.

18. The method of claim 14, further comprising arranging a seal on the cable for sealing against flushing liquid supplied to the drill string.

19. The method of claim 14, further comprising arranging the cable reserve on the first end of the rotary feedthrough such that the cable reserve is spaced apart from a connection on the second end of the rotary feed through for connecting the rotary feed through with a rod section.

20. The method of claim 14, further comprising holding the cable under tension by a motor or cylinder functionally connected to the cable reserve.

21. The method of claim 20, wherein when the motor or cylinder comprises the motor, the motor comprises one of an electromotor or a pneumatic motor, and wherein when the motor or cylinder comprises a cylinder, the cylinder comprises one of a hydraulic cylinder, an electro-cylinder, or a pneumatic cylinder.

* * * * *